United States Patent [19]

Kurzweg

[11] Patent Number: 4,976,311

[45] Date of Patent: Dec. 11, 1990

[54] HEAT EXCHANGER EMPLOYING FLUID OSCILLATION

[75] Inventor: Ulrich H. Kurzweg, Gainesville, Fla.

[73] Assignee: University of Florida, Gainesville, Fla.

[21] Appl. No.: 273,078

[22] Filed: Nov. 18, 1988

[51] Int. Cl.[5] ..... F28F 13/10

[52] U.S. Cl. ..... 165/84; 165/109.1; 165/166

[58] Field of Search ..... 165/84, 109.1, 166

[56] References Cited

U.S. PATENT DOCUMENTS

| | | | |
|---|---|---|---|
| 2,514,797 | 7/1950 | Robinson | 165/84 |
| 2,937,500 | 5/1960 | Bodine, Jr. | 165/84 |
| 3,265,123 | 8/1966 | Gifford | 165/104.34 |
| 3,814,172 | 6/1974 | Shore | 165/84 |

FOREIGN PATENT DOCUMENTS

| | | | |
|---|---|---|---|
| 2552536 | 3/1985 | France | 165/84 |
| 846950 | 9/1956 | United Kingdom | 165/84 |

*Primary Examiner*—Albert W. Davis, Jr.

*Attorney, Agent, or Firm*—Kerkam, Stowell, Kondracki & Clarke

[57] ABSTRACT

A heat exchange device is provided for use as a cross flow heat exchanger, preferably for use as a liquid-liquid cross flow exchanger, having a stack of thin metallic plates having channel walls for defining channels for cold and hot fluid flow paths traversing therethrough on opposite sides of the plates. Improved heat transfer coefficients and heat transfer rates are attained by providing oscillators for inducing oscillation and turbulence in the fluids as they are passed from inlet to outlet chambers through their respective channels.

35 Claims, 3 Drawing Sheets

HEAT EXCHANGER EMPLOYING FLUID OSCILLATION

BACKGROUND OF THE INVENTION

1. Field of the Invention

The present invention relates to heat exchangers, and more particularly to cross-flow liquid-liquid heat exchangers employing resonant oscillation of two fluids.

2. Description of Related Art

Methods and devices have heretofore been disclosed for transporting heat via sinusoidal oscillations of fluids between a hot and cold region. A U.S. Patent to Gifford (U.S. Pat. No. 3,265,123) discloses a heat exchanger which sinusoidally transports fluids, primarily gases, to heat or cool solid objects.

A further U.S. Patent issued to the inventor of the present invention (U.S. Pat. No. 4,590,993) discloses a device which transports or transfers large quantites of heat without an accompanying net transfer of mass. The heat transfer in that patent is effected by oscillating a working fluid within a set of ducts, the extent of fluid movement being less than the duct length. This patent provides a device which advantageously may be employed as a substitute for a heat pipe, while providing much higher heat transport rates than conventional heat pipes.

These devices are examples of advances in the general technology of heat transfer. However, heretofore lacking in the prior art is an apparatus or device which provides greatly improved heat transfer between a hot fluid and a cold fluid in a heat exchanger, for example a cross-flow heat exchanger, by employing an oscillation of the fluids.

It is therefore a principal object of the present invention to provide a heat exchange device which provides a heat transfer coefficient which is one or more orders of magnitude greater than that found in conventional heat exchangers.

It is a further object of the present invention to provide a heat exchange device which combines a novel heat transfer surface configuration with a means for oscillating a portion of the device inducing oscillation in the hot and cold fluids between which heat is transferred.

It is yet another object of the present invention to provide a heat exchange device having improved heat transfer capabilities, which can be made in smaller sizes and less expensively that conventional heat exchangers having the same heat transfer capability.

SUMMARY OF THE INVENTION

The above and other objects of the present invention are accomplished by providing a heat exchange device or apparatus which is designed to transfer heat between a hot and a cold fluid with a vastly improved heat transfer coefficient produced by inducing oscillations and turbulence in the fl ids as they are passed along heat exchange surfaces.

The hot and cold fluids are periodically brought into rapid thermal contact without accompanying convective or diffusional mass exchange across thin metal interfaces between the flow paths. Oscillation-induced turbulence and thin thermal boundary layers formed along the metal plate interfaces by using higher oscillation frequencies can yield heat transfer coefficient values which exceed $10^5$ W/m$^2$K when using water as the working fluid.

The inventive heat exchange device accomplishes such objects in a first embodiment comprising:

a first fluid flow path means for directing a first fluid through said heat exchange device;

a second fluid flow path means for directing a second fluid through said heat exchange device; the first and said second fluid flow paths being adapted to place the first and the second fluids in heat transfer communication with each other; and means for inducing oscillatory movement in the first and the second fluids when the first and the second fluids are in heat transfer communications.

A further embodiment in which the object of the present invention are accomplished is a heat exchange device comprising:

heat transfer surface means defining a first and a second fluid flow path for channeling a cold and a hot fluid through the first and the second fluid flow paths, the first and second fluid flow paths being adapted to be in heat transfer communication;

a cold fluid inlet means for introducing the cold fluid into the first fluid flow path;

a cold fluid outlet means for receiving the cold fluid after the cold fluid has passed through the first fluid flow path, the cold fluid outlet means further comprising means for removing the cold fluid from the device;

a hot fluid inlet means for introducing the hot fluid into the second fluid flow path;

a hot fluid outlet means for receiving the hot fluid after the hot fluid has passed through the second fluid flow path, the hot fluid outlet means further comprising means for removing the hot fluid from the device; and means for oscillating at least one of the cold fluid and the hot fluid when the cold and hot fluids are passed through the first and second flow paths.

The objects of the present invention are accomplished in a further embodiment of a heat exchange device comprising:

a cold fluid flow path having an inlet means, an inlet chamber adapted to receive cold fluid from the inlet means, a plurality of cold fluid channels comprising a plurality of parallel plate means for transferring heat thereacross and a first set of associated channel walls defining side boundaries of the channels, an outlet chamber adapted to receive the cold fluid passing from the inlet chamber through the plurality of cold fluid channels, and an outlet means for removing the cold fluid from the outlet chamber;

a hot fluid flow path having an inlet means, an inlet chamber adapted to receive hot fluid from the inlet means, a plurality of hot fluid channels comprising the plurality of parallel plate means and a second set of associated channel walls defining side boundaries of the channels, an outlet chamber adapted to receive the hot fluid passing from the inlet chamber though the plurality of hot fluid channels, and an outlet means for removing the hot fluid from the outlet chamber;

wherein the first set of channel walls and the second set of channel walls are disposed in an alternating manner in successive spacings between the plates whereby the cold fluid and the hot fluid pass in the cold fluid and the hot fluid channels on opposite sides of the plates in heat transfer communication with each other; and means for inducing oscillation in the cold and hot fluids when the cold and hot fluids are passed through the channels.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment of the present invention taken in conjunction with the accompanying drawings wherein like reference characters represent like parts throughout the several views, and wherein.

DETAILED DESCRIPTION OF THE PREFERRED EMBODIMENT

Figure 1:
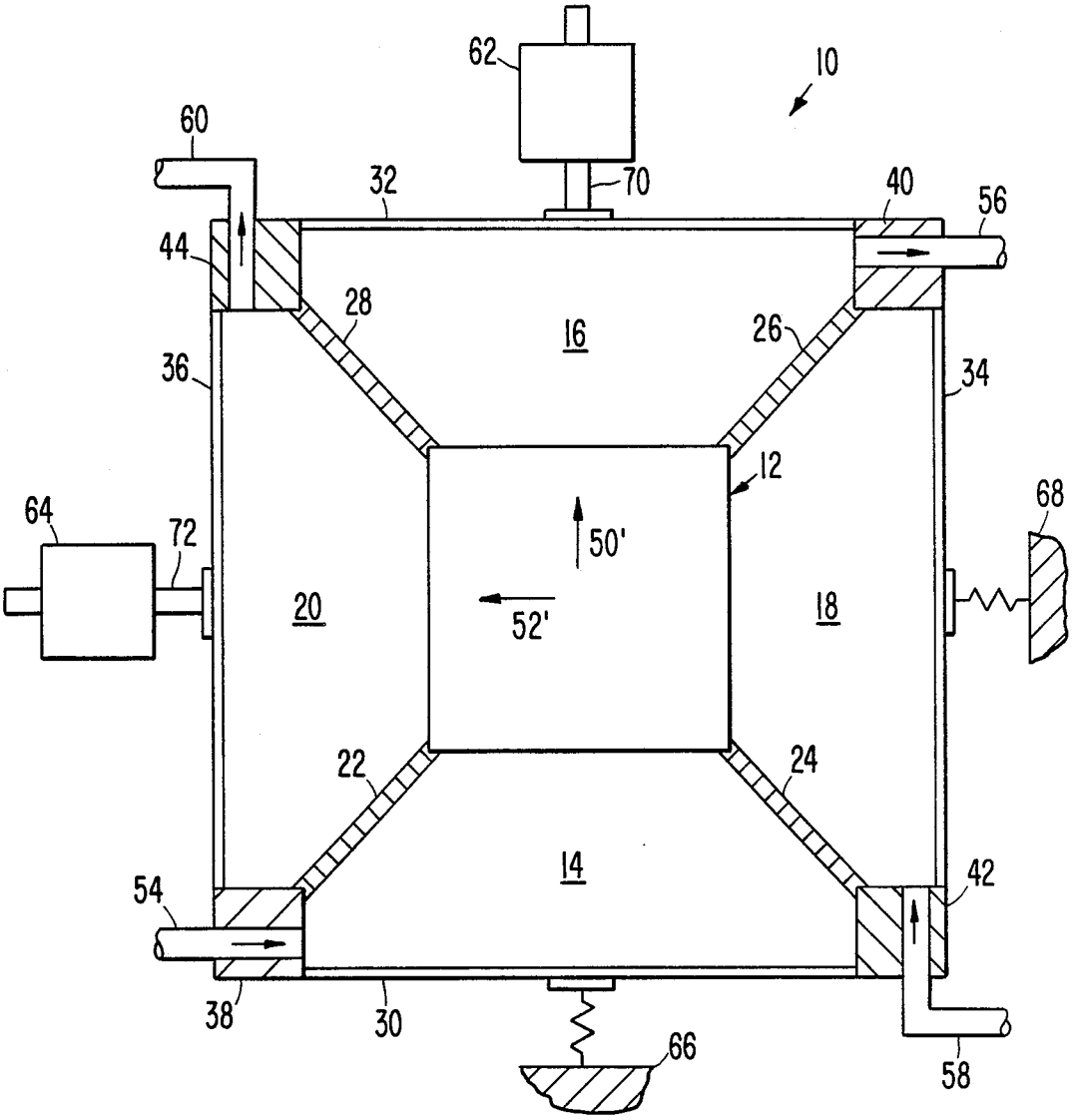
FIG. 1 is a diagrammatical view of the heat exchange device according to a preferred embodiment of the present invention.

Referring initially to FIG. 1, a diagrammatic representation of the heat exchange device 10 of the present invention is illustrated. Although the figure does not provide full structural detail of the device 10, representations of the basic components are shown in what may be considered a cross-section (i.e. top panel removed), looking vertically downwardly through the device 10.

A plurality of thin metallic plates 12 arranged in a substantially horizontal, spaced apart stacking manner are provided in a center portion of the heat exchanger. Plates 12 are surrounded by four chambers 14, 16, 18, 20. Each of chambers 14, 16, 18, 20 is bounded by two side walls and a membrane, all of which extend vertically spanning an entire height of the heat exchange device 10. Chamber 14 is bounded by side walls 22, 24 and member 30; chamber 16 is bounded by side walls 26, 28 and membrane 32; chamber 18 is bounded by side walls 24, 26 and membrane 34; and chamber 20 is bounded by side walls 22, 28 and membrane 36. For reasons which will be discussed in more detail at a later part of this specification, the membranes are preferably constructed such that an oscillatory or periodic motion may be induced in the membranes. This may be accomplished by making the membranes of a thin sheet material, either of rubber or other resilient material, of a flexible sheet metal, or the like. As depcited, the four membranes may be rigidly attached at corners in a square-like configuration, each corner having a corner post 38, 40, 42, 44 to which two perpendicularly disposed membranes are attached. Also attached to corner posts 38, 40, 42, 44 are the side walls, each of the side walls being substantially rigid and extending diagonally in the depicted embodiment from an associated corner post to a corner of the stack of metallic plates 12, the four side walls supporting the metallic plates in position.

Figure 2:
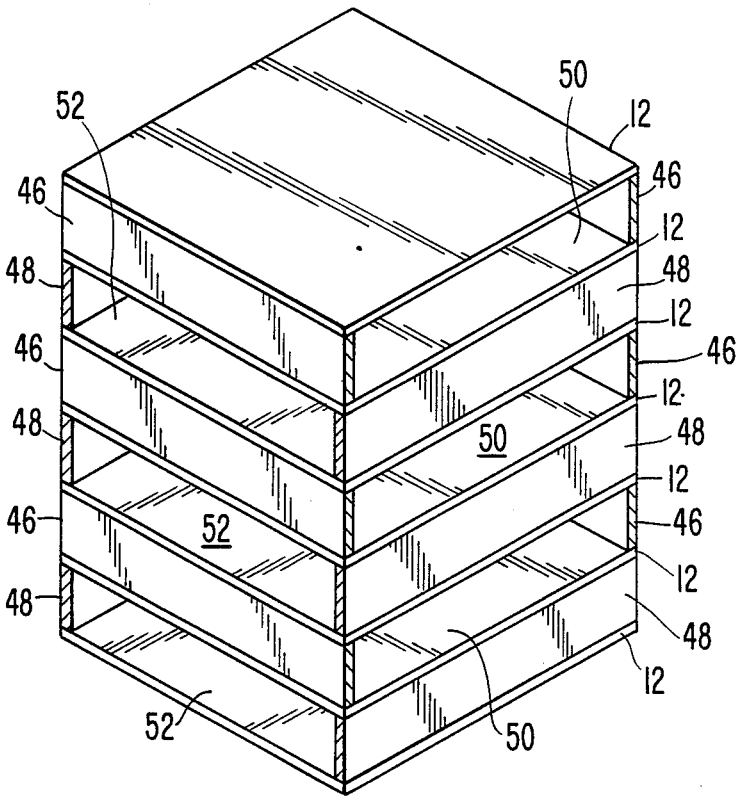
FIG. 2 is a perspective view of the stack of metallic plates used to effect a cross-flow of the fluids passing through the heat exchange device.

Looking now at FIG. 2, the arrangement of the stack of metallic plates 12 will be described to provide an understanding of the pattern of fluid flow in the heat exchanger 10. The plates 12 are preferably square-shaped and each of the plates may have typical dimensions on the order of 10 cm $\times$10 cm $\times$0.1 cm thickness). It is to be emphasized at the outset that FIG. 2 is not drawn to scale, as the plates shown are substantially thicker in proportion to the length and width of the plates than they would be in practice. The plates 12 are preferably separated from one another by about 0.2 cm by channel walls 46, 48, forming fluid channels 50, 52 through the plates 12. Only a portion of a typical stack of plates is shown in FIG. 2, as such a stack may have a total height on the order of 10 cm, which would employ approximately 30 plates. Fluid channel 50, 52 flow directions are indicated in FIG. 1 by arrows 50', 52' for convenient reference purposes.

As can be seen in FIG. 2, channel walls 46, 48 are disposed at a 90° angle of orientation to one another, and the channel walls 46 are alternated with channel walls 48 between adjacent pairs of plates, thus forming a cross flow heat exchanger configuration wherein heat may be transferred across plate members 12 between two fluids flowing through neighboring channels 50, 52, which enter and exit a different pair of oppositely disposed chambers (FIG. 1).

Referring back to FIG. 1, channels 50 place chambers 14, 16 in fluid communication with each other, while channel walls 48 associated with channels 52 block fluid flow from either of chambers 14, 16 into chambers 18, 20. Channels 52 in turn place chambers 18, 20 in fluid communication, while channel walls 46 associated with channels 50 block fluid flow from chambers 18, 20 into either of chambers 14, 16.

Fluid inlets and outlets for the chambers are provided, in the depicted preferred embodiment, through corner posts 38, 40, 42, 44. As with conventional cross flow heat exchangers, a hot fluid and a cold fluid are passed through separate fluid flow paths, which are defined by the stack of plates 12 having channels or flow paths 50, 52 extending therethrough. It is to be recognized that, as used herein, the terms "hot" and "cold" are used to describe relative temperatures of the fluids between which heat is to be exchanged, and the terms are not intended to indicate absolute temperatures of either fluid.

Corner post 38 provides an inlet therethrough for a cold fluid inlet line 54 feeding chamber 14. Channels 50 direct the cold fluid accumulating in chamber 14 into chamber 16 and the cold (now warmed) fluid exits the exchanger through cold (warmed) fluid outlet line 56 which extends through corner post 40. In a similar fashion, corner post 42 has a hot fluid inlet line 58 extending therethrough into communication with chamber 18. The accumulating hot fluid in chamber 18 is directed through channels 52 into chamber 20 and the hot (now cooled) fluid exits the exchanger through hot (cooled) fluid outlet line 60.

As described to this point, the heat exchange device 10 performs in a substantially similar manner as a conventional cross flow heat exchanger. The crossing flow of the hot fluid and the cold fluid through the channels 50, 52 formed by the stack of plates 12 will produce some temperature drop of the hot fluid and some temperture rise in the cold fluid. The heat exchanger device 10 of the present invention, however, provides vastly increased heat transfer coefficients by providing means for oscillating the fluids as the fluids are passed through channels 50, 52.

In the depicted preferred embodiment of the heat exchange device, membranes 30, 32, 34, 36 are set into periodic motion by a pair of induction oscillators 62, 64 and associated springs 66, 68. Oscillator 62 and spring 66 coact to induce oscillating movement and turbulence in the cold fluid flowing from chamber 14 to chamber 16 through channels 50, and oscillator 64 and spring 68 coact to induce oscillating movement, and also turbulence, in the hot fluid flowing from chamber 18 through channels 52 into chamber 20. The induced flow oscillation and turbulence improves the heat exchange between the hot and cold fluids, particularly when the system is operated as described in further detail below.

Oscillators 62, 64, represented in schematic form in FIG. 1, may be of various conventional designs, and for the purposes of discussion, the oscillators 62, 64 will operate reciprocating arms 70, 72 attached to external surfaces of membranes 32, 36, respectively, moving the membranes with linear strokes.

The oscillators 62,64 are advantageously operated with a stroke length sufficient to cause portions of the fluids to move from the first chamber or reservoir, i.e. chamber 14 or 18, completely through channels 50 or 52 to the opposite reservoir or chamber 16, 20 during a single cycle. When the fluids are moved in such a manner, a much thinner thermal boundary layer is established in the fluids next to the metal walls than is attainable with a steady flow transport in the absence of oscillations, enhancing heat transfer across plates 12. The heat transfer enhancement is achieved with the present heat exchanger by operating the oscillators such that the net fluid exchange between opposite chambers, i.e. between chambers 14 and 16, and between chambers 18 and 20, is appreciably higher than the steady flow transport rate in the absence of oscillations.

An analytical calculation (approximate) has shown that a heat exchange coefficient, h, attainable by oscillating the fluids, is proportional to the product of the square root of the fluid's turbulent thermal diffusivity and the oscillation frequency. In order to provide a comparison to conventional cross flow heat exchanger heat exchange coefficients, computer evaluations have been performed. Computer evaluations for laminar heat exchange using water under laminar conditions in channels of 2 mm height and having highly conducting bounding walls, and a fluid stroke amplitude of 4 cm, yielded a heat transfer coefficient, h, of $1.3 \times 10^4$ $W/m^2K$ at 5 Hz A corresponding heat transfer coefficient for a steady (non-oscillating) flow of 1 cm/sec, under otherwise identical conditions, was determined to be $8 \times 10^2$ $W/m^2K$, or 16 times less.

The computer evaluation discussed above with the oscillating fluid did not take into account a turbulent oscillating flow, which experiments have indicated will exist in the exchanger when oscillation is induced in the manner described. The turbulence in the oscillating fluid is estimated to enhance heat transfer by another order of magnitude.

An additional important aspect of the present invention is that the exchanger 10 may be operated under resonant conditions in order to minimize the energy required to run the oscillators 62, 64. This is accomplished by employing springs 66, 68 whose spring constant is equal to the product of the fluid mass contained in one half of the heat exchanger multiplied by the square of the angular oscillation frequency. In a typical oscillation-equipped liquid-liquid heat exchanger according to the present invention, an oscillation frequency in the range of about 1 to about 20 Hz would advantageously be employed to attain a resonant condition. An oscillation system such as that described for use in the heat exchange device of the present invention will have viscous losses, however, such losses will have a sufficiently small magnitude such that sharp (high Q) tuning curves will exist in the vicinity of the resonance point.

Total heat exchange flow rates of heat exchange devices according to the present invention also demonstrate the vast improvements provided over conventional exchangers. As an example, a substantially cubical plate stack of a 10 cm $\times$ 10 cm $\times$ 10 cm dimension, having channels 2 mm high, and fluids (here water) of a 20° C. temperature difference and flowing in resonance and turbulence at an imposed frequency of 10 Hz, may be considered. Such an exchanger configuration is estimated to produce an initial heat exchange flow rate of 900 kilowatts compared to about one-hundredth (1/100) of that amount for the same geometry or configuration, in the absence of oscillations and turbulence. Thus, it can be seen that much smaller heat exchangers (with oscillating fluids) would be required to provide the same heat exchange capacity.

Figure 3:
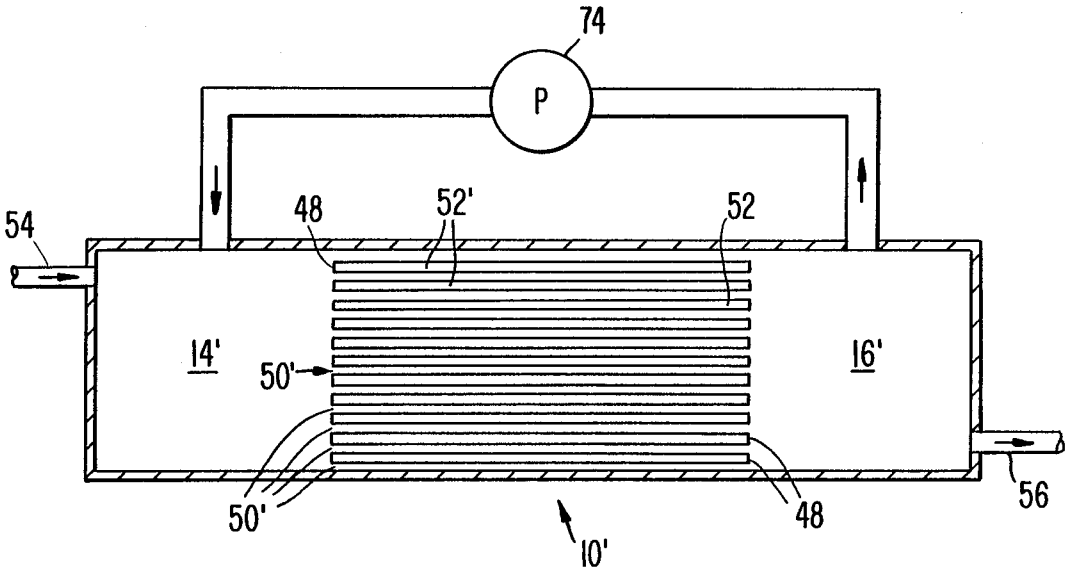
FIG. 3 is a partial cross-sectional representation of an internal portion of the heat exchanger of the present invention.

FIG. 3 depicts, in an approximate or partial cross-section form, an alternative embodiment of the heat exchange device 10' of the present invention. This figure depicts only one of the associated pairs of chambers 14', 16' with channels 50' extending there between. Channels 52' extend crosswise with channels 50 and thus would direct fluid flow into or out of the page, as shown in FIG. 3.

The primary difference in this embodiment is structural in nature, in that in lieu of induction oscillator 62 acting on a membrane for producing the oscillating or turbulent flow of the fluid, a pump 74 is provided which produces a turbulent flow of fluid. A pump may also be used to control the fluid flow in the second fluid flow path as well. With the selection and use of suitable pumps, the heat exchange device 10' transfers heat and otherwise operates in a similar manner to the embodiment employing the oscilltors.

The foregoing detailed description includes various details and particular structures according to the preferred embodiment of the invention, however, it is to be understood that these are for illustrative purposes only. Various modifications and adaptations will become apparent to those skilled in the art. Accordingly, the scope of the present invention is to be determined by reference to the appended claims.

What is claimed is:

1. A heat exchange device comprising:

a first fluid flow path means for directing a first fluid through said heat exchange device;

a second fluid flow path means for directing a second fluid through said heat exchange device; said first and said second fluid flow paths being adapted to place said first and said second fluids in heat transfer communication with each other; and means for inducing resonant axial oscillations in said first and said second fluids in directing said first and second fluids axially through said first and said second fluid flow path means.

2. A heat exchange device as defined in claim 1 further comprising heat transfer surface means for defining said first and said second fluid flow paths, said heat transfer surface means comprising a plurality of parallel plate means for separating said first and said second fluid flow paths.

3. A heat exchange device as defined in claim 2 wherein said plate means further comprises a first plurality of channels and a second plurality of channels, said first plurality of channels comprising a portion of said first fluid flow path, said second plurality of channels comprising a portion of said second fluid flow path; and wherein each of said first plurality of channels is in heat transfer communication with at least one of said second plurality of channels, and each of said second plurality of channels is in heat transfer communication with at least one of said first plurality of channels.

4. A heat exchange device as defined in claim 3, wherein said plate means comprises a plurality of metal plates stacked in a parallel, spaced apart manner, and said first plurality of channels and said second plurality of channels extend through said plurality of metal plates in an alternating manner.

5. A heat exchange device as defined in claim 4 wherein said first plurality of channels extends through said plurality of metal plates at a substantially 90° orientation with respect to said second plurality of channels.

6. A heat exchange device as defined in claim 5, wherein said first fluid flow path further comprises an inlet chamber and an outlet chamber, each of said inlet and said outlet chambers being bounded on one side by a flexible membrane; and wherein said second fluid flow path further comprises an inlet chamber and an outlet chamber, each of said inlet and said outlet chambers being bounded on one side by a flexible membrane.

7. A heat exchange device as defined in claim 6 wherein said means for oscillating said first and said second fluids comprises a first oscillator and a second oscillator, said first oscillator having first means for moving one of said inlet chamber membrane or said outlet chamber membrane of said first fluid flow path in an oscillatory manner, and said second oscillator having second means for moving one of said inlet chamber membrane or said outlet chamber membrane of said second fluid flow path in an oscillatory manner.

8. A heat exchange device as defined in claim 7 wherein said first moving means is connected to said outlet chamber membrane of said first fluid flow path, and wherein said second moving means is connected to said outlet chamber membrane of said second fluid flow path.

9. A heat exchange device as defined in claim 8 wherein said means for oscillating said first and second fluids further comprises a first spring connected to said inlet chamber membrane of said first fluid flow path, and a second spring connected to said inlet chamber membrane of said second fluid flow path.

10. A heat exchange device as defined in claim 2 wherein said first fluid flow path further comprises an inlet chamber and an outlet chamber, each of said inlet and said outlet chambers being bounded on one side by a flexible membrane; and wherein said second fluid flow path further comprises an inlet chamber and an outlet chamber, each of said inlet and said outlet chambers being bounded on one side by a flexible membrane.

11. A heat exchange device as defined in claim 10 wherein said means for oscillating said first and said second fluids comprises a first oscillator and a second oscillator, said first oscillator having first means for moving one of said inlet chamber membrane or said outlet chamber membrane of said first fluid flow path in an oscillatory manner, and said second oscillator having second means for moving one of said inlet chamber membrane or said outlet chamber membrane of said second fluid flow path in an oscillatory manner.

12. A heat exchange device as defined in claim 11 wherein said first moving means is connected to said outlet chamber membrane of said first fluid flow path, and wherein said second moving means is connected to said outlet chamber membrane of said second fluid flow path.

13. A heat exchange device as defined in claim 12 wherein said means for oscillating said first and second fluids further comprises a first spring connected to said inlet chamber membrane of said first fluid flow path, and a second spring connected to said inlet chamber membrane of said second fluid flow path.

14. A heat exchange device as defined in claim 13 wherein said first oscillator and said first spring associated therewith are so constructed and arranged to induce resonant fluid oscillation of said first fluid, and said second oscillator and said second spring associated therewith are so constructed and arranged to induce resonant fluid oscillation of said second fluid.

15. A heat exchange device as defined in claim 14 wherein said first and said second oscillators are adapted to produce angular oscillation frequencies in the range of about 1 to about 20 hz.

16. A heat exchange device as defined in claim 15 wherein each of said first and said second springs has a spring constant substantially equal to a product of a fluid mass contained in one-half of said heat exchange device multiplied by the square of said angular oscillation frequency.

17. A heat exchange device as defined in claim 1 wherein said first fluid is a liquid and said second fluid is a liquid.

18. A heat exchange device comprising:

heat transfer surface means defining a first and a second liquid flow path for channeling a cold and a hot liquid through said first and said second liquid flow path, said first and second liquid flow paths being adapted to be in heat transfer communication;

a cold liquid inlet means for introducing said cold liquid into said first liquid flow path;

a cold liquid outlet means for receiving said cold liquid after said cold liquid has passed through said first liquid flow path, said cold liquid outlet means further comprising means for removing said cold liquid from said device;

a hot liquid inlet means for introducing said hot liquid into said second liquid flow path;

a hot liquid outlet means for receiving said hot liquid after said hot liquid has passed through said second liquid flow path, said hot liquid outlet means further comprising means for removing said hot liquid from said device; and means for oscillating at least one of said cold liquid and said hot liquid for producing resonant axial liquid oscillation through an associated one of said first and second flow paths.

19. A heat exchange device as defined in claim 18 wherein said heat transfer surface means comprises a plurality of plate means for separating said first fluid flow path from said second fluid flow path;

said plurality of plate means being arranged in a substantially parallel, spaced apart stack configuration; and wherein said first and second flow paths are disposed in heat transfer communication with opposite sides of at least one of said plurality of plate means.

20. A heat exchange device as defined in claim 19 wherein said plurality of plate means is so constructed and arranged that said first fluid flow path and said second fluid flow path are disposed to pass said cold and hot fluids therethrough substantially at right angle directions.

21. A heat exchange device as defined in claim 20 further comprising a cold fluid inlet chamber and a cold fluid outlet chamber disposed on opposing sides of said plate means, said cold fluid inlet chamber and said cold fluid outlet chamber adapated to be in fluid communication with said first fluid flow path;

a hot fluid inlet chamber and a hot fluid outlet chamber disposed on opposing sides of said plate means, said hot fluid inlet chamber and said hot fluid outlet chamber adapted to be in fluid communication with said second fluid flow path; and wherein said cold inlet and outlet chambers are disposed at a substantially 90° rotation with respect to said hot inlet and outlet chambers.

22. A heat exchange device as defined in claim 21 wherein each of said cold fluid inlet and outlet chambers and said hot fluid inlet and outlet chambers comprises a pair of substantially rigid walls extending from an associated side of said plate means, and a flexible membrane extending between each pair of substantially rigid walls.

23. A heat exchange device as defined in claim 22 wherein said oscillating means comprises a first and a second reciprocating oscillator, said first oscillator engaging the membrane of said cold fluid outlet chamber, and said second oscillator engaging the membrane of said hot fluid outlet chamber, and wherein said first and second oscillators are operable to induce oscillatory motion in said cold and hot fluids by moving said membranes in an oscillatory manner.

24. A heat exchange device as defined in claim 23 wherein said first and second oscillators are so constructed and arranged to provide a reciprocating stroke length sufficient to move predetermined portions of said cold and hot fluids completely through said plate means in a single stroke cycle.

25. A heat exchange device as defined in claim 24 wherein said first and second oscillators are designed to operate at oscillation frequencies sufficient to produce resonant flow of said cold and hot fluids.

26. A heat exchange device as defined in claim 25 wherein said first and second oscillators are designed to operate at angular oscillation frequencies ranging from on the order of 1 to 20 Hz.

27. A heat exchange device as defined in claim 19 wherein said plurality of plate means comprises a plurality of thin metal plates having a thickness on the order of 0.1 cm.

28. A heat exchange device as defined in claim 27 wherein said plates are spaced apart at a distance of about 0.2 cm.

29. A heat exchange device as defined in claim 28 wherein said plates are spaced and said first and second fluid flow paths are defined by a pair of channel walls disposed at peripheral edges of said plates between each pair of adjacent plates.

30. A heat exchange device as defined in claim 29 wherein said plates are substantially square-shaped and each of said pairs of channel walls is disposed at a 90° angle of rotation to a neighboring pair of channel walls.

31. A heat exchange device as defined in claim 18 wherein said cold fluid is a liquid and said hot fluid is a liquid.

32. A heat exchange device comprising:

a cold fluid flow path having an inlet means, and inlet chamber adapted to receive cold fluid from said inlet means, a plurality of cold fluid channels comprising a plurality of parallel plate means for transferring heat thereacross and a first set of associated channel walls defining side boundaries of said channels, an outlet chamber adapted to receive said cold fluid passing from said inlet chamber through said plurality of cold fluid channels, and an outlet means for removing said cold fluid from said outlet chamber;

a hot fluid flow path having an inlet means, an inlet chamber adapted to receive hot fluid from said inlet means, a plurality of hot fluid channels comprising said plurality of parallel plate means and a second set of associated channel walls defining side boundaries of said channels, an outlet chamber adapted to receive said hot fluid passing from said inlet chamber through said plurality of hot fluid channels, and an outlet means for removing said hot fluid from said outlet chamber;

wherein said first set of channel walls and said second set of channel walls are disposed in an alternating manner in successive spacings between said plates whereby said cold fluid and said hot pass in said cold fluid and said hot fluid channels on opposite sides of said plates in heat transfer communication with each other; and means for inducing resonant axial fluid oscillation in said cold and hot fluids in an axial direction through said hot and cold fluid channels.

33. A heat exchange device as defined in claim 32 wherein said channels carrying said cold fluid have a direction of flow which is at a 90° orientation with respect to said channels carrying said hot fluid.

34. A heat exchange device as defined in claim 33 wherein said means for inducing oscillation in said cold and hot fluids comprises a cold fluid and a hot fluid pump means for pumping said cold fluid and said hot fluid into said cold fluid and said hot fluid inlet chambers in an oscillating and turbulent manner.

35. A heat exchange device as defined in claim 32 wherein said cold fluid is a liquid and said hot fluid is a liquid.

* * * * *